US007845153B2

(12) United States Patent
Chung et al.

(10) Patent No.: US 7,845,153 B2
(45) Date of Patent: Dec. 7, 2010

(54) PROCESS AND SYSTEM FOR PRODUCING DIGITAL YARNS USING METAL FILAMENTS FOR INFO-COMMUNICATIONS AND DIGITAL YARNS PRODUCED BY SAID PROCESS

(75) Inventors: Gi-Soo Chung, Gyeonggi-Do (KR); Dae-Hoon Lee, Gyeonggi-Do (KR); Jae Sang An, Gyeonggi-Do (KR)

(73) Assignee: Korea Institute of Industrial Technology, Seoul (KR)

( * ) Notice: Subject to any disclaimer, the term of this patent is extended or adjusted under 35 U.S.C. 154(b) by 96 days.

(21) Appl. No.: 11/660,723

(22) PCT Filed: Jan. 4, 2007

(86) PCT No.: PCT/KR2007/000054

§ 371 (c)(1),
(2), (4) Date: Oct. 23, 2008

(87) PCT Pub. No.: WO2007/094563

PCT Pub. Date: Aug. 23, 2007

(65) Prior Publication Data

US 2009/0056300 A1 Mar. 5, 2009

(30) Foreign Application Priority Data

Feb. 17, 2006 (KR) ..... 10-2006-0015724

(51) Int. Cl.
*D02G 3/02* (2006.01)

(52) U.S. Cl. ..... 57/210; 57/232

(58) Field of Classification Search ..... 57/210, 57/232, 252, 257, 258
See application file for complete search history.

(56) References Cited

U.S. PATENT DOCUMENTS

| | | | | |
|---|---|---|---|---|
| 5,206,085 | A * | 4/1993 | Nakagawa et al. | 428/372 |
| H1225 | H * | 9/1993 | Foy et al. | 57/5 |
| 5,248,548 | A * | 9/1993 | Toon | 428/222 |
| 5,617,713 | A * | 4/1997 | Mawick et al. | 57/210 |
| 6,260,344 | B1 * | 7/2001 | Chakravarti | 57/230 |
| 6,318,060 | B1 * | 11/2001 | Dinkelmann et al. | 57/3 |
| 6,534,175 | B1 * | 3/2003 | Zhu et al. | 428/365 |
| 7,155,891 | B2 * | 1/2007 | Bader | 57/210 |
| 2008/0182103 | A1 * | 7/2008 | Chung et al. | 428/365 |

* cited by examiner

*Primary Examiner*—Shaun R Hurley
(74) *Attorney, Agent, or Firm*—Reinhart Boerner Van Deuren

(57) ABSTRACT

A process and system of producing conductive yarns in use for info-communication and conductive yarns produced thereby, in which the conductive yarns are produced using metal filaments. The process includes the steps of feeding a plurality of metal filaments, heating the plurality of metal filaments to soften the plurality of metal filaments, drafting the plurality of metal filaments and cutting the plurality of metal filaments into a plurality of slivers having a predetermined length, drawing and twisting the plurality of slivers into a yarn, winding the yarn on a bobbin, coating the yarn with a waterproof material and an electromagnetic shielding material in a thin film while unwinding the yarn from the bobbin, and drying the yarn, and covering the yarn with a textile yarn.

18 Claims, 3 Drawing Sheets

[Fig. 1]
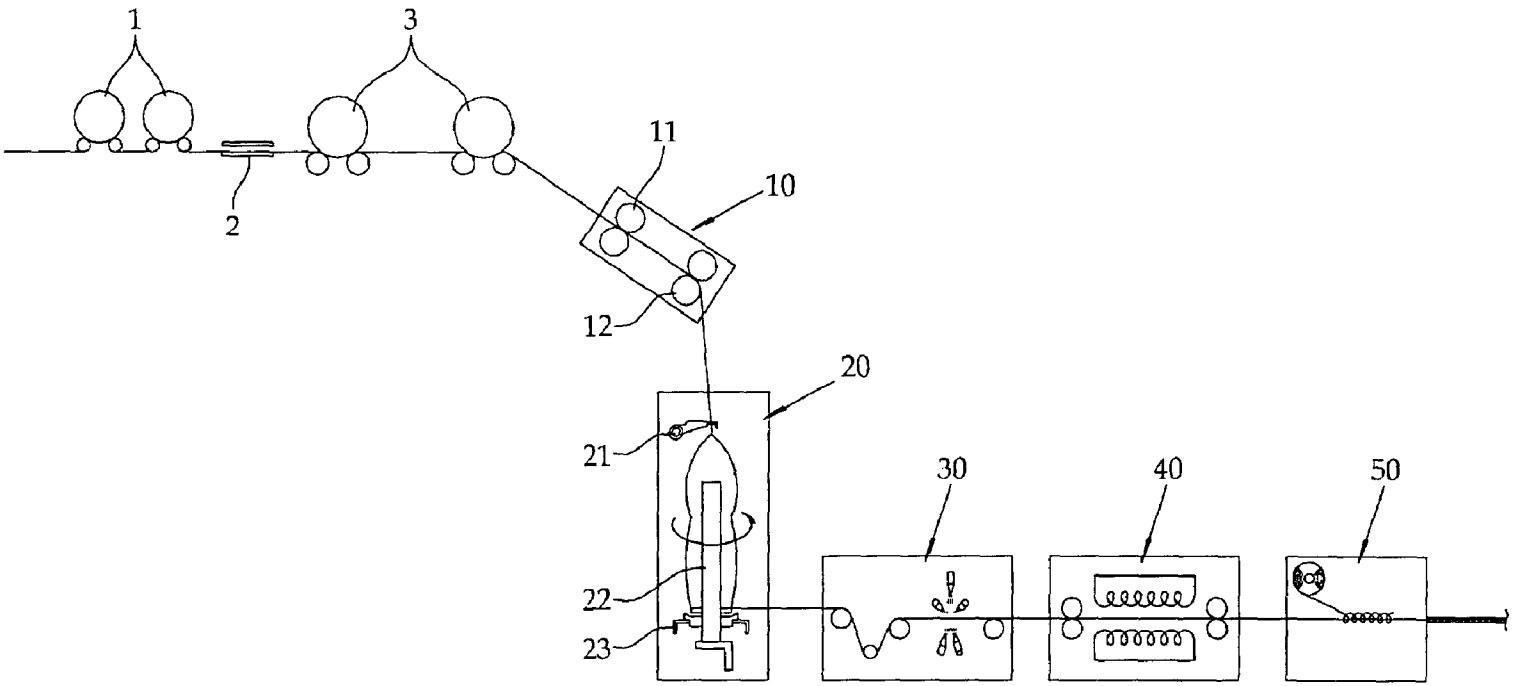

[Fig. 2]
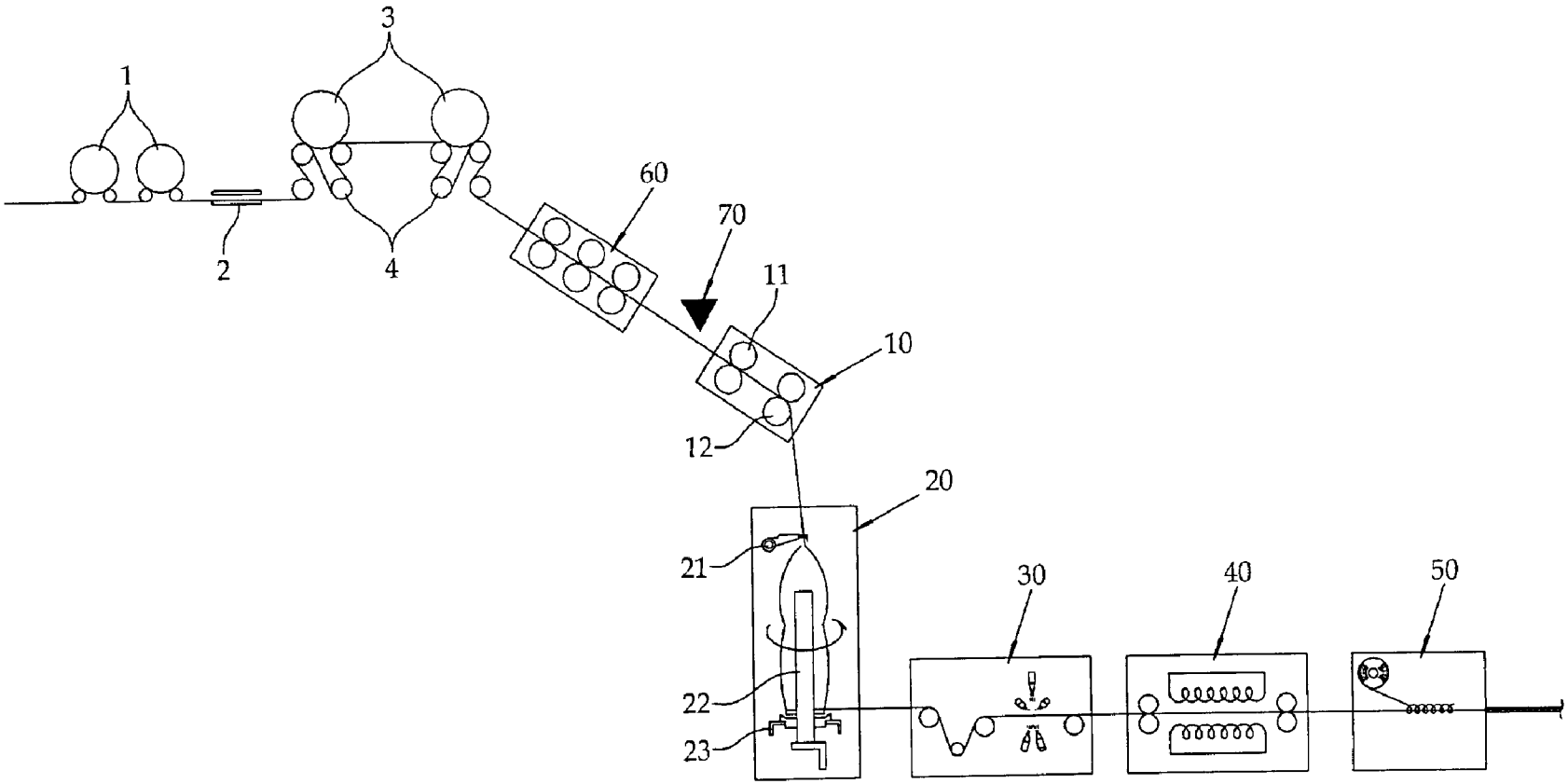

[Fig. 3]
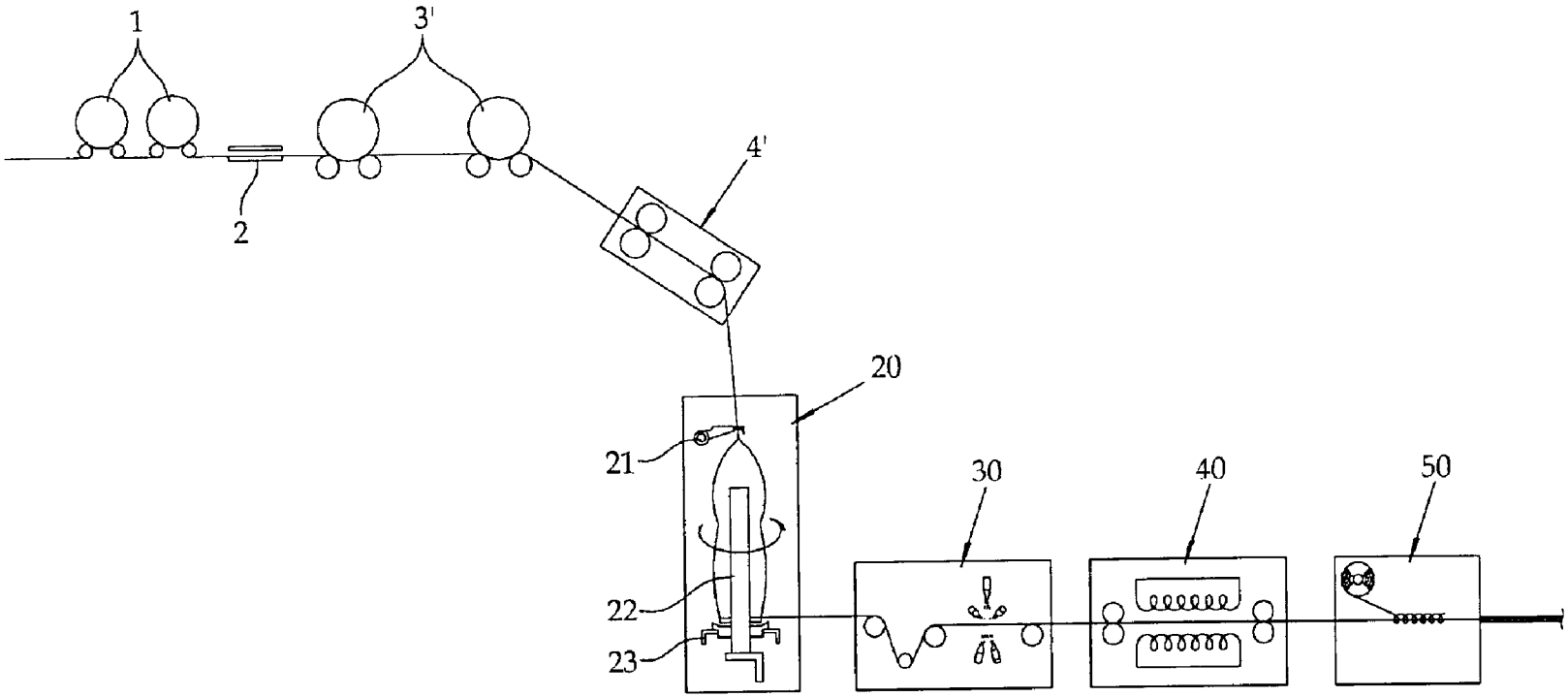

PROCESS AND SYSTEM FOR PRODUCING DIGITAL YARNS USING METAL FILAMENTS FOR INFO-COMMUNICATIONS AND DIGITAL YARNS PRODUCED BY SAID PROCESS

TECHNICAL FIELD

The present invention relates to a process and system of producing conductive yarns in use for info-communication and, more particularly, to a process and system of producing conductive yarns, which can be used for wearable computers in info-communication, by using metal filaments and conductive yarns produced thereby.

BACKGROUND ART

The terminology "conductive yarn" (or digital yarn) refers to yarns which can conduct electrons to transfer information as well as be woven or knitted so that clothes can be made of the conductive yarns. Weaves (cloth or stock made by the interlacing of warps and threads) or knits (cloth or stock made by the interlacing of yarns or threads in a series of connected loops) made of conductive yarns can act as a circuit of a circuit board of an electronic appliance to connect electronic modules to each other, thereby enabling data transmission. That is, the conductive yarns can connect a bio-signal sensor with a communication medium or a memory, or with an electronic module to enable computing. Thus, the conductive yarns can be used in wearable computer fields, and it is expected that they will be used more in the future.

Recently, there are attempts to provide a computer as a part of clothes for the purpose of info-communication. One of such attempts in the early stage was to attach metal parts of a computer to the clothes. Lately, a computer is attached to clothes so that its constitutional parts are not exposed. Furthermore, there is an approach to assemble computer parts with materials of clothes so that a computer can be provided as a part of the clothes.

In order to fabricate a piece of clothes in which a wearable computer is provided as a part of the clothes, conductive textiles (or digital textiles) capable of being used in info-communication have to be produced and, first of all, conductive yarns capable of being used in info-communication have to be produced in order to make the conductive textiles. To produce the conductive yarns, metal filaments are typically used. The term metal filament refers to a fine metal wire.

However, conventional processes of producing conductive yarns using metal filaments have several drawbacks. That is, high rigidity and brittleness of metal often breaks the metal filaments during the process, thereby worsening productivity and thus raising production costs. In addition, the conductive yarns tend to be broken during weaving and/or knitting, thereby degrading weaving and/or knitting efficiency. Even though the conductive yarns are made into a piece of clothes, some of the conductive yarns used, for example, in an elbow part of the clothes easily break owing to repeated bending so that the clothes lose info-communication ability. Furthermore, in view of the characteristics of metal, it is difficult to wash the clothes. Accordingly, there are real demands for advanced processes of producing conductive yarns which can overcome such problems.

DISCLOSURE OF INVENTION

Technical Problem

It is therefore an aspect of the invention to provide a process of producing conductive yarns, which can overcome the existing problems of poor productivity owing to high rigidity and brittleness of metal filament.

Another aspect of the invention is to provide a process of producing conductive yarns, which can improve drawability and friction characteristics of conductive yarns to decrease breakage during knitting and weaving.

Further another aspect of the invention is to provide a process of producing conductive yarns, which can mass economically produce the conductive yarns by employing a simpler process than conventional yarn production processes.

Yet another aspect of the invention is to provide a process of producing conductive yarns, which do not easily break even if used in a repeatedly bending part, such as an elbow, and which can maintain info-communication ability even after washed for several times.

Technical Solution

In order to realize any of the foregoing aspects of the invention, the process of producing conductive yarns includes steps of:

(i) feeding a number of metal filaments;

(ii) heating the metal filaments to soften the same;

(iii) drafting the plurality of metal filaments and cutting the softened metal filaments into a predetermined length of slivers;

(iv) drawing and twisting the slivers into a yarn;

(v) winding the yarn on a bobbin;

(vi) coating the yarn with a waterproof material and electromagnetic shielding material in a thin film while unwinding the yarn from the bobbin;

(vii) drying the thin film-coated yarn; and (viii) covering the yarn with a textile yarn.

ADVANTAGEOUS EFFECTS

The process of producing conductive yarns using metal filaments according to exemplary embodiments of the invention can significantly decrease breakages of filaments or spun yarns, which may take place in the process, in order to improve productivity and save production costs.

According to the process of producing conductive yarns using metal filaments according to exemplary embodiments of the invention, an additive liquid is fed in the process of the conductive yarns to improve drawability and friction characteristics of metal spun yarns and enhance cohesive force, thereby yielding fine yarns with a minimized cross section. Furthermore, in subsequent procedures, such as knitting and weaving, breakages can be reduced.

In addition, according to the process of producing conductive yarns using metal filaments according to exemplary embodiments of the invention, the conductive yarns are coated with electromagnetic shielding and waterproof materials to protect a user from electromagnetic waves when he/she wears a wearable computer made of the conductive yarns. In addition, the wearable computer can be washed when soiled.

Furthermore, conductive yarns made by the production process using metal filaments according to exemplary embodiments of the invention is covered by a common textile yarn. This can remove breakages owing to friction in subsequent procedures, such as knitting and weaving. In addition, it is also possible to produce the conductive yarns with various colors by dying covering yarns.

Moreover, the second process of producing conductive yarns using metal filaments according to exemplary embodiments of the invention can omit complicated procedures of producing, drawing and twisting slivers and thus mass produce the conductive yarns more simply and economically.

DESCRIPTION OF DRAWINGS

FIG. 1 schematically illustrates an embodiment of a system used in a first process of producing conductive yarns in use for info-communication by using metal filaments according to the invention;

FIG. 2 schematically illustrates another embodiment of a system used in the first process of producing conductive yarns in use for info-communication by using metal filaments according to the invention; and FIG. 3 schematically illustrates an embodiment of a system used in a second process of producing conductive yarns in use for info-communication by using metal filaments according to the invention.

MAJOR REFERENCE SIGNS OF THE DRAWINGS

1: Feed roller
2: Heater
3: Stretching roller
4: Anti-slip roller
3': Collector
4': Twisting unit
10: Spinning frame
11: Back roller
12: Front roller
20: Winder
21: Yarn guide
22: Bobbin
23: Traveler/ring
30: Coater
40: Drier
50: Covering unit
60: Drawing unit
70: Additive liquid feeder

BEST MODE

A first process of producing conductive yarns will now be described in detail.

Step (i) of feeding a number of metal filaments is carried out in such a fashion that the metal filaments are not cut or scattered. The metal filaments used have a diameter of, but are not limited to, about 1 to 20 μm.

Step (ii) of heating the metal filaments to soften the same is carried out. This step is needed to complement the properties of metal filament such as large rigidity, unlike common textiles, which are obstacles against drafting and cutting. With the heat treatment, the metal structure is softened to such a degree that the metal filaments can be cut through drafting.

In step (iii), cord-like continuous slivers are produced. The softened metal filaments are drafted and cut into the slivers having a predetermined length. In this case, step (iii) is preferably performed together with a slip-preventing step in order to prevent any slip of the filaments that may otherwise take place during the drafting.

Steps (iv) and (v) are performed in the same fashion as in a typical spun yarn production process. Step (iv) draws and twits the slivers to raise the pressure among the slivers and enhance friction strength, thereby producing a spun yarn. In step (v), the spun yarn produced in step (iv) is wound on a bobbin.

A common yarn production process includes a series of procedures called "spinning," in which short fibers such as staple fibers are produced into a predetermined thickness of roves through mixing-and-blowing, carding, combing, drawing, and roving, and then the roves are fed into a spinning frame, which in turn produces yarns of a desired yarn number according to a draft ratio. Yarns produced through such a process are also called "spun yarns."

Prior to the drawing of the slivers in step (iv), it is possible to carry out an additional step of permeating additive liquid into the slivers and drying a residue of the additive liquid on the surface of the slivers. This step can maximize the collection of fibers of high surface friction coefficient before the drawing to enhance cohesive force of the fibers, thereby decreasing spinning triangles and enabling uniform drafting. This as a result can improve the strength, elongation and friction characteristics of a resultant spun yarn to remove breakage in subsequent procedures, such as knitting and weaving, as well as produce fine fibers with minimized cross section owing to the maximization of their cohesive force. Here, the term "spinning triangle" refers to a triangular part without twisting, formed in the range from the front roller 12 to a point where a yarn is produced. This is caused as the twisting, created in a traveler/ring, is not completely transferred to the front roller. Such additive liquid may adopt all liquid materials including water. It is preferable, however, to contain a small amount of surface active agent in order to improve the permeation rate of the additive liquid into fibers and uniformity.

In step (vi), an electromagnetic shielding material and a waterproof material are coated in the form of a thin film on the yarn which is being unwound from the bobbin under a predetermined tension. The electromagnetic shielding and waterproof materials can be adopted from any materials which have electromagnetic shielding and waterproof functions. This procedure is useful especially when clothes are made of the resultant conductive yarns. That is, electromagnetic waves harmful to the human body can be shielded and, even if the clothes are washed, the washing does not impair the ability of info-communication through electron transfer.

In step (vii), the thin film-coated yarn is dried so that the coated materials can be excellently attached to the yarn.

Preferably, steps (vi) and (vii) are repeated for 3 to 5 times in succession.

Finally, the yarn is covered with a textile yarn in step (viii). That is, a common textile yarn is covered around the yarn so that the common textile yarn forms the outer surface of the conductive yarn. With this procedure, clothes made of the conductive yarns can give a wearer with a feeling the same as those made of the common textile yarns. This can also remove breakage owing to friction in subsequent procedures such as knitting and weaving. Examples of the common textile yarns in use for the covering may include dyed yarn, synthetic yarn, or natural fiber.

The process of producing conductive yarns of the invention may further include a procedure between steps (iii) and (iv) in order to improve the evenness of the slivers. That is, several slivers produced by step (iii) are drawn together into a thickness the same as the thickness of one original sliver through doubling and drafting. With this procedure, the evenness of the metal slivers can be improved.

A system in use for the process of producing conductive yarns is shown in FIG. 1, and includes: feed rollers 1 for feeding a number of metal filaments, a heater 2 for heating the metal filaments to soften the same, stretching rollers 3 for drafting and cutting the softened metal filaments into a predetermined length of slivers, a spinning frame 10 for drawing and twisting the slivers into a yarn, a winder 20 for winding the spun yarn, a coater 30 for coating a waterproof material and an electromagnetic shielding material in the form of a thin film on the yarn while unwinding the yarn from a bobbin 22, a drier 40 for drying the thin film-coated yarn, and a covering unit 50 for covering the yarn with a textile yarn.

The system for producing conductive yarns will now be described in detail with reference to FIG. 1.

The feed rollers 1 act to feed the metal filaments uniformly so as not to be broken or scattered.

The heater 2 heats the metal filaments fed from the feed rollers 1 to soften the metal structure to the extent that the metal filaments can be cut through drafting.

The stretching rollers 3 include two or more rollers, and have a higher rotation rate at an output side than at an input side so that the metal filaments, softened by the heater 2, can be cut under the difference of rotation rates between the rollers. The length of the slivers can be adjusted by adjusting the distance of the rollers because the length of the slivers is the same as the distance of the rollers.

The spinning frame 10 includes a back roller 11 and a front roller 12, and acts to draw and twist the slivers to raise the pressure among the slivers and enhance friction strength, thereby producing a spun yarn. The spinning frame 10 may further include a middle roller between the back roller 11 and the front roller 12 like a typical ring spring frame. The roller gauge, i.e. the central distance difference between roller pairs, is preferably, but not limited to, on the order of 80 to 200 mm.

The winder 20 is a part for winding the spun yarn on the bobbin 22, and includes a yarn guide 21, the bobbin 22 and a traveler/ring 23. The yarn guide 21 functions to prevent any tangling during the winding of the spun yarn produced in the spinning frame 10, the bobbin 22 is a part on which the spun yarn is wound, and the traveler rotates on the ring to wind the spun yarn on the bobbin 22 while creating twisting rotation to the spun yarn. The drawing and the winding are produced by the relative movement of the traveler and the bobbin on the ring.

The coater 30 acts to coat the yarn with a thin film of an electromagnetic shielding material and a waterproof material in nanometer scale while unwinding the yarn from the bobbin under a predetermined tension. In the coater 30, three to five spray nozzles are arranged in the form of a ring to uniformly spray the electromagnetic shielding material and the waterproof material.

The drier 40 provides a high temperature heating zone for rapidly drying the film-coated part of the film-coated yarn when it passes through the heating zone.

The covering unit 50 acts to wind a common textile yarn around the spun yarn so that the common textile yarn covers the spun yarn.

In addition, the system of the invention may further include anti-slip rollers 4, a drawing unit 60 and an additive feeder 70. (FIG. 2)

The anti-slip rollers 4 are arranged at both sides of the stretching rollers 3, respectively, to prevent any slip in the slivers. Without this, the slivers will slip instead of being stretched during the drafting.

The drawing unit 60 is arranged between the stretching rollers 3 and the spinning frame 10 to improve the uniformity of the metal slivers through doubling, drafting and so on, by which several slivers are drawn together into a thickness the same as the original thickness of one sliver.

The additive feeder 70 is combined to the top end of the back roller 11 of the spinning frame 10 to feed additive liquid to permeate into the slivers and to dry the residue of the additive liquid on the surface of the slivers by microwave and so on.

A second process of producing conductive yarns according to the invention includes steps of:

(i') feeding a number of metal filaments;

(ii') heating the metal filaments to soften the same;

(iii') collecting the softened metal filaments;

(iv') twisting the collected metal filaments to produce a filament yarn;

(v') winding the filament yarn on a bobbin;

(vi') coating the filament yarn with a waterproof material and an electromagnetic shielding material in a thin film while unwinding the filament yarn from the bobbin;

(vii') drying the film-coated filament yarn; and (viii') covering the filament yarn with a textile yarn.

The second process of producing conductive yarns of the invention is substantially the same as the first process of producing conductive yarns of the invention, but differs from the first process in that the metal filaments are directly collected and then twisted in steps (iii') and (iv') in order to produce the filament yarn in place of steps (iii) and (iv) of the first process of drafting and cutting metal filaments and then drawing and heating the metal filaments. Accordingly, the second process of producing conductive yarns can be used to mass produce conductive yarns more simply by omitting complicated and time/cost consuming procedures of making, drawing and twisting slivers from the actual yarn production process.

A system in use for the second process of producing conductive yarns includes: feed rollers 1 for feeding a number of metal filaments, a heater 2 for heating the metal filaments to soften the same, a collector 3' for collecting the softened metal filaments, a twisting unit 4' for twisting the collected filaments into a filament yarn, a winder 20 for winding the filament yarn on a bobbin 22, a coater 30 for coating a waterproof material and an electromagnetic shielding material in the form of a thin film on the filament yarn while unwinding the filament yarn from the bobbin 22, a drier 40 for drying the thin film-coated filament yarn, and a covering unit 50 for covering the filament yarn with a textile yarn. (FIG. 3)

The system of this embodiment is substantially the same as the system in use for the first process of producing conductive yarns of the invention, but differs in that the collector 3' and the twisting unit 4' are provided in place of the stretching rollers 3 and the spinning frame 10.

The invention claimed is:

1. A process for producing conductive yarns for use in info-communication, the process comprising:

(i) feeding a plurality of metal filaments;

(ii) heating the plurality of metal filaments to soften the plurality of metal filaments;

(iii) drafting the plurality of metal filaments and cutting the plurality of metal filaments into a plurality of slivers having a predetermined length;

(iv) drawing and twisting the plurality of slivers into a yarn;

(v) winding the yarn on a bobbin;

(vi) coating the yarn with a waterproof material and an electromagnetic shielding material in a thin film while unwinding the yarn from the bobbin;

(vii) drying the yarn; and (viii) covering the yarn with a textile yarn.

2. The process according to claim 1, further comprising: between the step (iii) and the step (iv), simultaneously doubling and drafting the plurality of slivers produced by the step (iii) to improve the evenness of the plurality of slivers.

3. The process according to claim 1, wherein the step (iii) is carried out together with a slip-preventing step to prevent slips in the plurality of filaments in the drafting.

4. The process according to claim 1, further comprising: permeating an additive liquid into the plurality of slivers and drying a residual of the additive liquid from a surface of the plurality of slivers before the step (iv).

5. The process according to claim 4, wherein the additive liquid contains a small amount of surface active agent therein.

6. The process according to claim 1, further comprising: repeating the steps (vi) and (vii) for three to five times in succession.

7. The process according to claim 1, wherein the textile yarn is a dyed fiber.

8. The process according to claim 1, wherein the textile yarn is a natural fiber.

9. A conductive yarn for use in info-communication, the conductive yarn comprising:

a plurality of slivers, wherein the plurality of slivers are drafted and cut from a plurality of metal filaments, wherein the plurality of metal filaments are heated to soften the plurality of metal filaments, wherein the plurality of slivers are drawn and twisted;

a first coating on the plurality of slivers, wherein the first coating is a water proof material;

a second coating on the plurality of slivers, wherein the second coating is an electromagnetic shielding material; and a covering on the plurality of slivers, wherein the covering is a textile yarn.

10. A system for producing conductive yarns for use in info-communication, comprising:

a feed roller for feeding a plurality of metal filaments;

a heater for heating the plurality of metal filaments to soften the plurality of metal filaments;

a plurality of stretching rollers for drafting the plurality of metal filaments, wherein the stretching rollers are arranged such that the stretching rollers cut the plurality of metal filaments into a plurality of slivers with a predetermined length;

a spinning frame for drawing and twisting the plurality of slivers into yarn, wherein the spinning frame has a back roller and a front roller;

a winder for winding the yarn;

a coater for coating the yarn with a waterproof material and an electromagnetic shielding material in a thin film while unwinding the yarn from a bobbin;

a drier for drying the yarn; and a covering unit for covering the yarn with a textile yarn.

11. The system according to claim 10, further comprising: a drawing unit arranged between one of the plurality of stretching rollers and the spinning frame to perform doubling and drafting to enhance evenness of the plurality of slivers.

12. The system according to claim 10, further comprising: anti-slip rollers arranged at both sides of one of the plurality of stretching rollers, respectively, to prevent slips of the plurality of metal filaments during drafting of the plurality of metal filaments.

13. The system according to claim 10, further comprising: an additive liquid feeder arranged at a top portion of the back roller to permeate an additive liquid into the plurality of slivers and to dry a residual of the additive liquid from surfaces of the plurality of slivers.

14. A process for producing conductive yarns for use in info-communication, the process comprising:

(i') feeding a plurality of metal filaments;

(ii') heating the plurality of metal filaments to soften the plurality of metal filaments;

(iii') collecting the plurality of metal filaments;

(iv') twisting the plurality of metal filaments to produce a filament yarn;

(v') winding the filament yarn on a bobbin;

(vi') coating a waterproof material and an electromagnetic shielding material in a thin film on the filament yarn while unwinding the filament yarn from the bobbin;

(vii') drying the filament yarn; and (viii') covering the filament yarn with a textile yarn.

15. The process according to claim 14, further comprising: repeating the steps (vi') and (vii') for three to five times in succession.

16. The process according to claim 14, wherein the textile yarn is a dyed fiber.

17. The process according to claim 14, wherein the textile yarn is a synthetic fiber.

18. A system for producing conductive yarns for use in info-communication, comprising:

a feed roller for feeding a plurality of metal filaments;

a heater for heating the plurality of metal filaments to soften the plurality of metal filaments;

a collector for collecting the plurality of metal filaments;

a twisting unit for twisting the plurality of metal filaments into a filament yarn;

a winder for winding the filament yarn on a bobbin;

a coater for coating the filament yarn with a waterproof material and an electromagnetic shielding material in a thin film while unwinding the filament yarn from the bobbin;

a drier for drying the filament yarn; and a covering unit for covering the filament yarn with a textile yarn.

* * * * *